US005216855A

United States Patent [19]

Richter et al.

[11] Patent Number: 5,216,855

[45] Date of Patent: Jun. 8, 1993

[54] CONSTRUCTION FOR REMOVABLY RETAINING GLAZING MATERIAL

[75] Inventors: Stephen T. Richter; Donald R. Trombley, both of Marysville, Wash.

[73] Assignee: Crystalite Inc., Everett, Wash.

[21] Appl. No.: 690,180

[22] Filed: Apr. 19, 1991

[51] Int. Cl.[5] ..... E04B 7/18

[52] U.S. Cl. ..... 52/200; 52/397; 52/398; 49/DIG. 2

[58] Field of Search ..... 52/200, 397, 398, 399; 49/DIG. 2

[56] References Cited

U.S. PATENT DOCUMENTS 4,123,883 11/1978 Barber, Jr. et al. ..... 52/200
4,395,847 9/1983 Atchison .
4,449,340 5/1984 Jentoft et al. ..... 52/200

OTHER PUBLICATIONS

Lexan Sheet For Architectural Glazing, G. E. Plastics, pp. 21-25, publication date unknown.
Lexan Thermoclear Sheet, G. E. Plastics, pp. 15, 17, 19 and 21, publication date unknown.

*Primary Examiner*—Richard E. Chilcot, Jr.
*Assistant Examiner*—Wynn E. Wood
*Attorney, Agent, or Firm*—Graybeal Jackson Haley & Johnson

[57] ABSTRACT

A construction for removably retaining a first sheet of glazing adjacent to a second sheet of glazing is disclosed including a fixed frame member adapted to be attached to a glazing cap, and a removable retaining flange connectable to the fixed frame member. The flange-holding side wall of the fixed frame member has a shoulder containing a longitudinal groove adjacent to the flange, and a longitudinal recess having an upper edge and a lower edge including a catch. The retaining flange connects to the fixed frame member by nesting the upper end edge of a vertical leg of the flange into the flange-holding groove of the frame member and locking a lip of the flange member to the catch along the lower edge of the fixed frame recess. When the fixed frame member and the removable retaining flange are connected, the flange of the fixed frame member and the horizontal leg of the removable retaining flange removably brace a first sheet of glazing therebetween.

22 Claims, 6 Drawing Sheets

FIG. 7
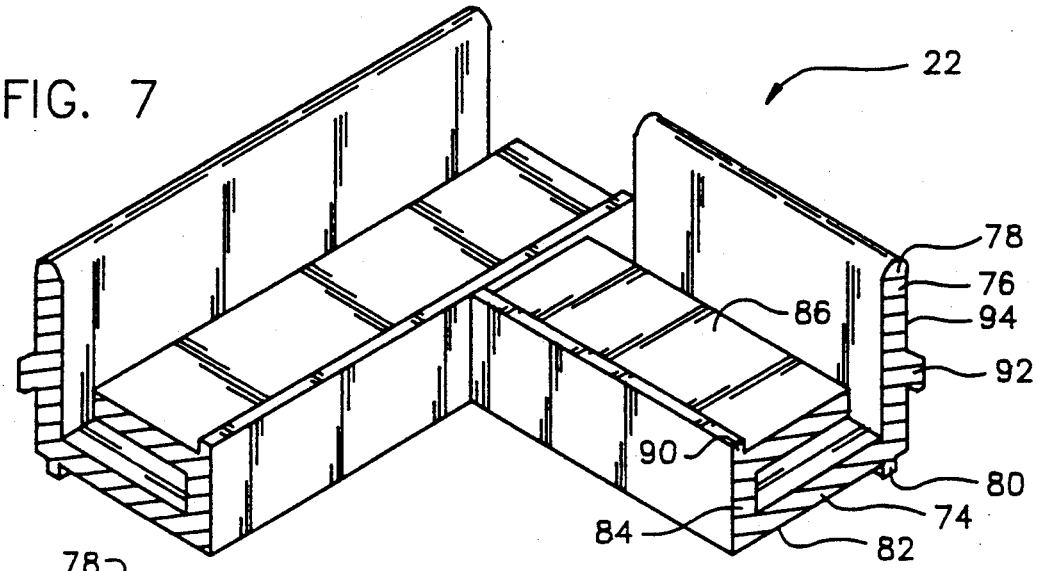
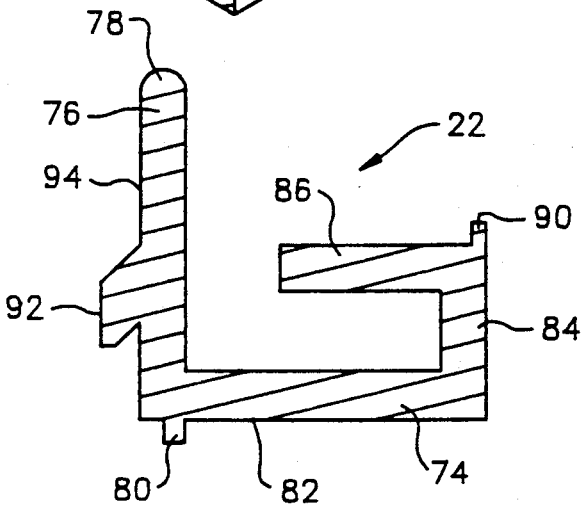
FIG. 8
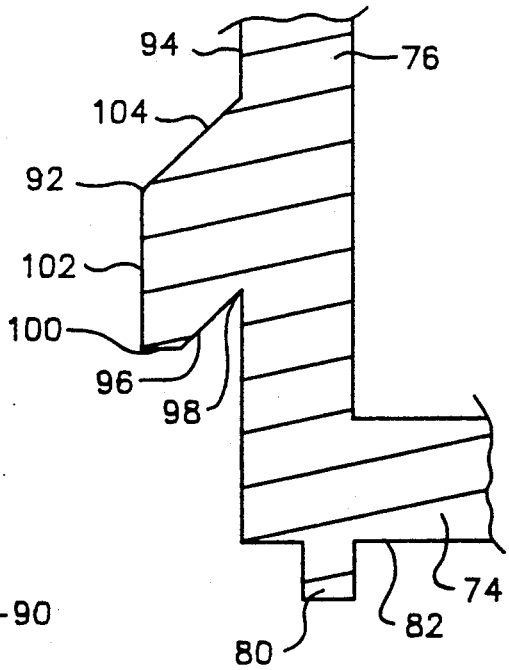
FIG. 9
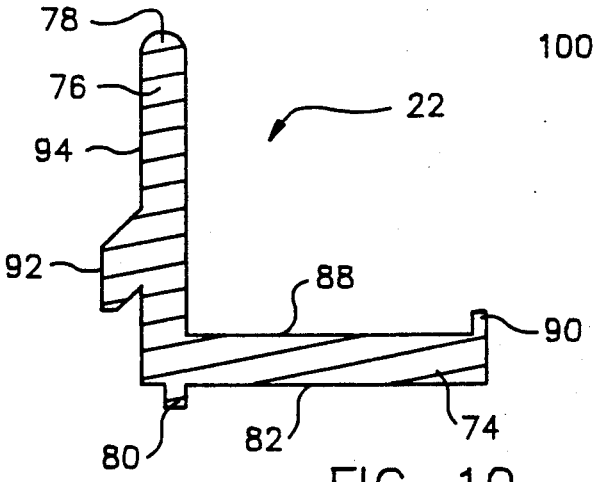
FIG. 10

CONSTRUCTION FOR REMOVABLY RETAINING GLAZING MATERIAL

BACKGROUND OF THE INVENTION

The present invention relates to retaining frames for removably securing a sheet of glazing material adjacent other sheets of glazing material. More particularly, the present invention pertains to a construction for removably retaining a sheet of light transmissive insulating glazing adjacent framed skylight glazing or the like.

More than one layer of glazing material is often employed in planar and domed skylight construction. Both the exterior glazing layer and the interior glazing layer may be comprised of, for example, glass, acrylic, or polycarbonate. The choice of glazing material employed depends upon optimizing such factors as U-value, heat gain, and shading co-efficient.

Increasingly stringent building energy codes have caused homebuilders and owners to be more aware of insulating properties of the glass installed in homes. Specifically, glazing materials and layers of glazing materials having specific minimum U-values (BTU/-hours×square feet×°F.) are often required to meet code specifications. A particular problem in the glass industry is satisfying the code specifications without losing light transmission through the glazing layers. In skylight construction, the interior glazing layers are often comprised of light transmissive insulating materials such as, for example, polycarbonate resin. These light transmissive insulating materials are frequently employed to attain satisfactory U-values. However, the glazing industry is currently lacking an adequate construction for removably securing these light transmissive insulating glazing materials adjacent to traditional skylight glazing.

Regardless of the glazing materials employed as the exterior and interior glazing layers, when multiple layers are used cleaning of the inside surface of the interior glazing layer is currently difficult. The retaining frames presently employed include complex components that are necessary to ensure a safe, secure connection of the two glazing layers. The complexity of these connections causes cleaning of the glazing and other skylight maintenance to be unduly labor intensive.

Specifically, a need exists for a lightweight yet strong construction for removably securing either insulating or non-insulating glazing to traditional skylight glazing, this construction being manufactured from economical materials. A need also exists for a construction of the above type that is convenient to connect and to separate, but that does not separate readily when foreign objects such as rocks, tree branches or hail break through the fragile skylight glazing and impact upon the shatter resistant insulating glazing.

SUMMARY OF THE INVENTION

The present invention is a construction for removably retaining an inner glazing sheet preferably comprised of light transmissive insulating material adjacent to a second sheet or dome of glazing. The outer glazing is usually exposed to the elements. A glazing cap and a glazing frame fixed to the inside perimeter of the cap are adapted to be securedly attached to structural supports of a house or building that define a glazing opening. The second, usually exterior, glazing is held between the cap flange and an opposing shoulder of the fixed frame. A removable retaining flange cooperating with the fixed frame removably holds the inner glazing sheet in place and braces it against environmental loads such as snow, rain and wind should the second, usually outer, glazing fail.

In a first embodiment of the present invention, the fixed frame member includes a top wall, bottom wall, two side walls, and a flange. The flange is attached to one of the two side walls and is parallel with the top wall. The flange-holding side wall has a shoulder containing a longitudinal groove adjacent to the flange, and a longitudinal side wall recess below the flange. The lower edge of the recess includes a catch edge and a seat that mate with the removable retaining flange to allow bracing of the inner glazing sheet.

In another aspect of the first embodiment, the removable retaining flange has a vertical leg and a horizontal leg. The end of the vertical leg mates in the groove of the fixed frame member shoulder during connection. The vertical leg has a lip that includes a recess angled to engage with the catch edge of the fixed frame member catch during connection. The lip additionally has a first face that is adjacent the lip recess and that fits flushly with the seat of the fixed frame member catch during connection. The lip also has a second face that is adjacent the first face and fits flushly with the side wall recess of the fixed frame member during connection. Thus, when the fixed frame member and the removable retaining flange are connected, the flange of the fixed frame member and the horizontal leg of the removable retaining leg removably brace the inner glazing sheet.

In another aspect of the first embodiment, the fixed frame flange has a substantially longitudinal rib on the interior surface, and the horizontal leg of the removable retaining flange also has a substantially longitudinal rib on its interior surface. These ribs retain spacing gaskets located on each side of the inner glazing sheet.

In another aspect of the first embodiment, the fixed frame flange has a substantially longitudinal rib on the exterior surface so that the fixed frame flange defines a condensation gutter for collection of moisture from the glazing.

In another aspect of the first embodiment, a return flange is located o the removable retaining flange horizontal leg. The return flange seats a spacing gasket located on the inner glazing sheet and has a substantially longitudinal rib for retaining the spacing gasket.

In another aspect of the first embodiment, the construction of the present invention is comprised of polyvinyl chloride and the inner glazing sheet is comprised of light transmissive insulating material made of celled polycarbonate resin.

In a second embodiment of the present invention, a construction for removably retaining more than one sheet of inner glazing (that is preferably comprised of light transmissive insulating material) adjacent more than one sheet of other, usually exterior glazing sheets, includes a mullion and at least two removable retaining flanges. The mullion is removably connected to a glazing plate. The glazing plate is attached to a glazing cap such that exterior glazing sheets are secured between the glazing cap and the mullion-glazing plate combination. The mullion has a top wall, a bottom wall, and two side walls and thus defines a mullion hollow for housing a structural support tube. The top wall has a mullion flange on each top wall edge. Each mullion side wall has a shoulder containing a longitudinal groove adjacent to one of the mullion flanges. Each side wall also has a longitudinal recess below one of the mullion flanges. The lower edge of each side wall recess comprises a catch that includes a seat and a catch edge. The catch edge and seat of each side wall recess mate with a removable retaining flange to allow bracing of one of the interior glazing sheets.

In another aspect of the second embodiment, the two removable retaining flanges each have a vertical leg and a horizontal leg. The end of each horizontal leg engages one of the grooves of the shoulders of the mullion during connection. The vertical leg of each removable retaining flange has a lip that includes a recess angled to engage with one of the mullion catch edges during connection. Each lip has a first face that is adjacent the lip recess and that fits flushly with one of the seats of the mullion catch during connection. A second face on each lip is adjacent the first face and fits flushly with one of the mullion side wall recesses during connection. Each of the two removable retaining flanges thus engages with a side wall of the mullion so that each of the two mullion flanges, in conjunction with one of the two removable retaining flange horizontal legs, removably braces one of the interior glazing sheets.

In another aspect of the second embodiment, the construction is comprised of polyvinyl chloride and the glazing plate and glazing cap are comprised of aluminum.

BRIEF DESCRIPTION OF THE DRAWINGS

These and other features of the present invention will be more fully appreciated when considered in the light of the following specification and drawings in which:

FIG. 7 is a perspective partial view of the removable retaining flange of the skylight construction of the present invention;

FIG. 8 is an end view of the removable retaining flange of FIG. 7;

FIG. 9 is an enlarged portion of the fixed frame member of FIG. 8;

FIG. 10 is an end view of another embodiment of the removable retaining flange of the present invention;

DETAILED DESCRIPTION OF THE PREFERRED EMBODIMENT

The present invention is a construction for removably securing a first sheet of glazing material, such as a light transmissive insulating sheet, adjacent a second sheet of glazing material, such as, for example, skylight glass.

Figure 1:
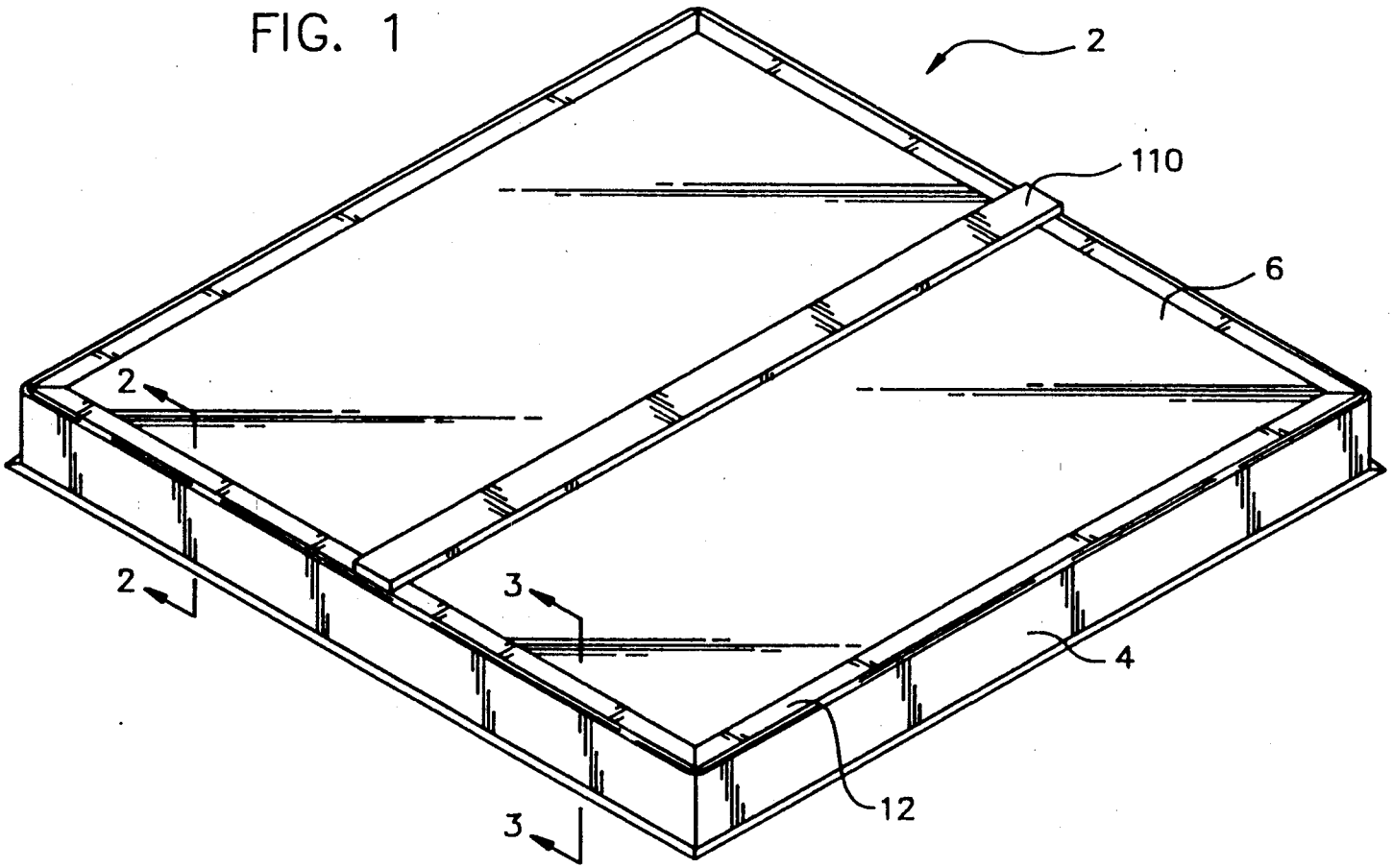
FIG. 1 is a perspective view of the skylight construction of the present invention.
Figure 2:
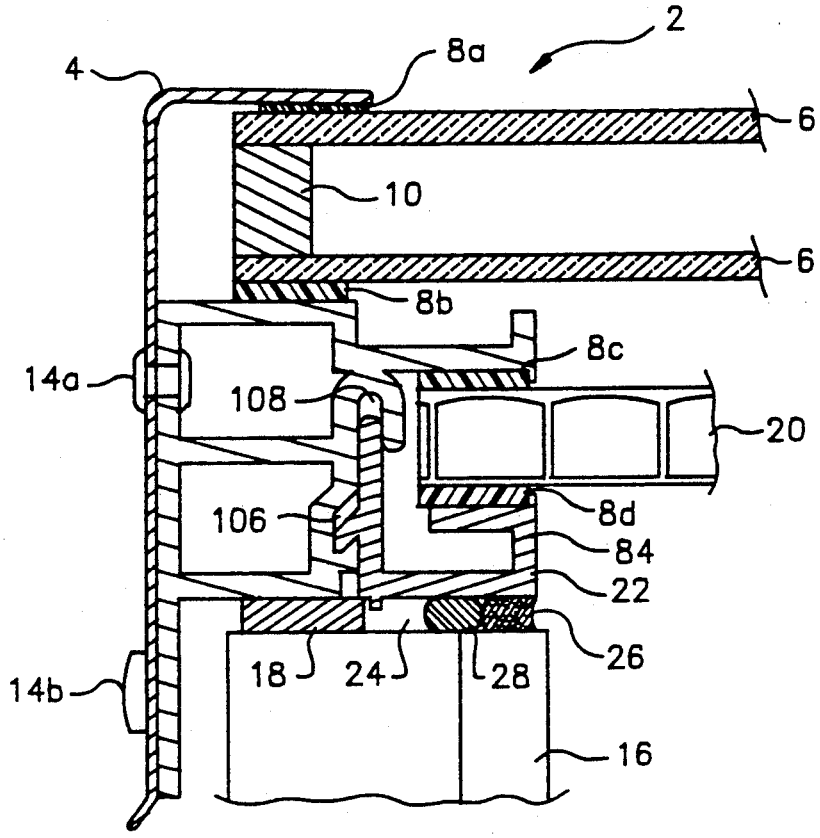
FIG. 2 is a simplified cross-sectional view of the skylight construction of FIG. 1 taken at lines 2—2.
Figure 3:
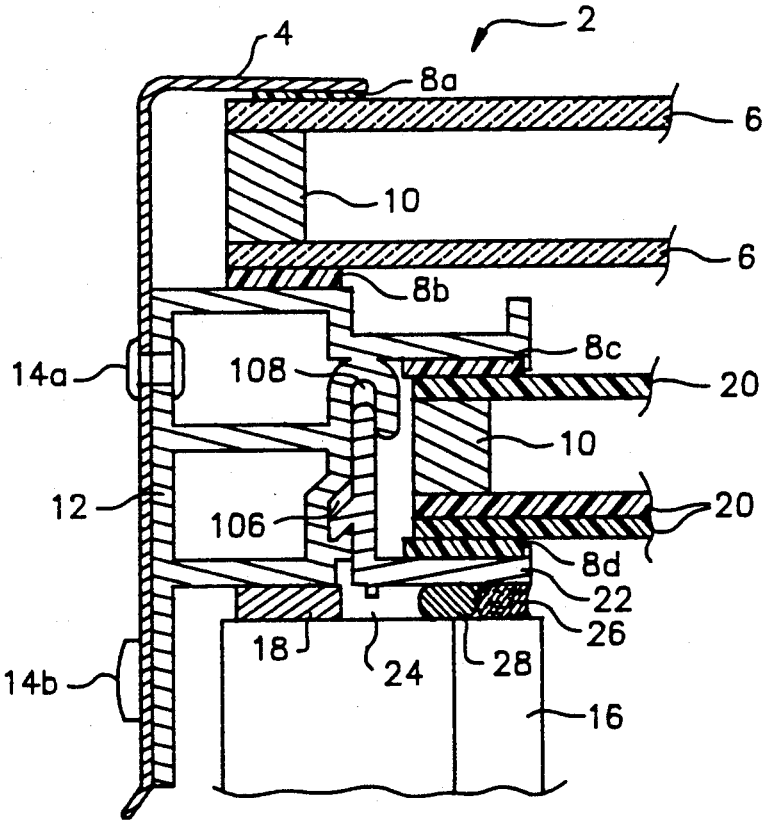
FIG. 3 is a simplified cross-sectional view of the skylight construction of FIG. 1 taken at lines 3—3.
Figure 4:
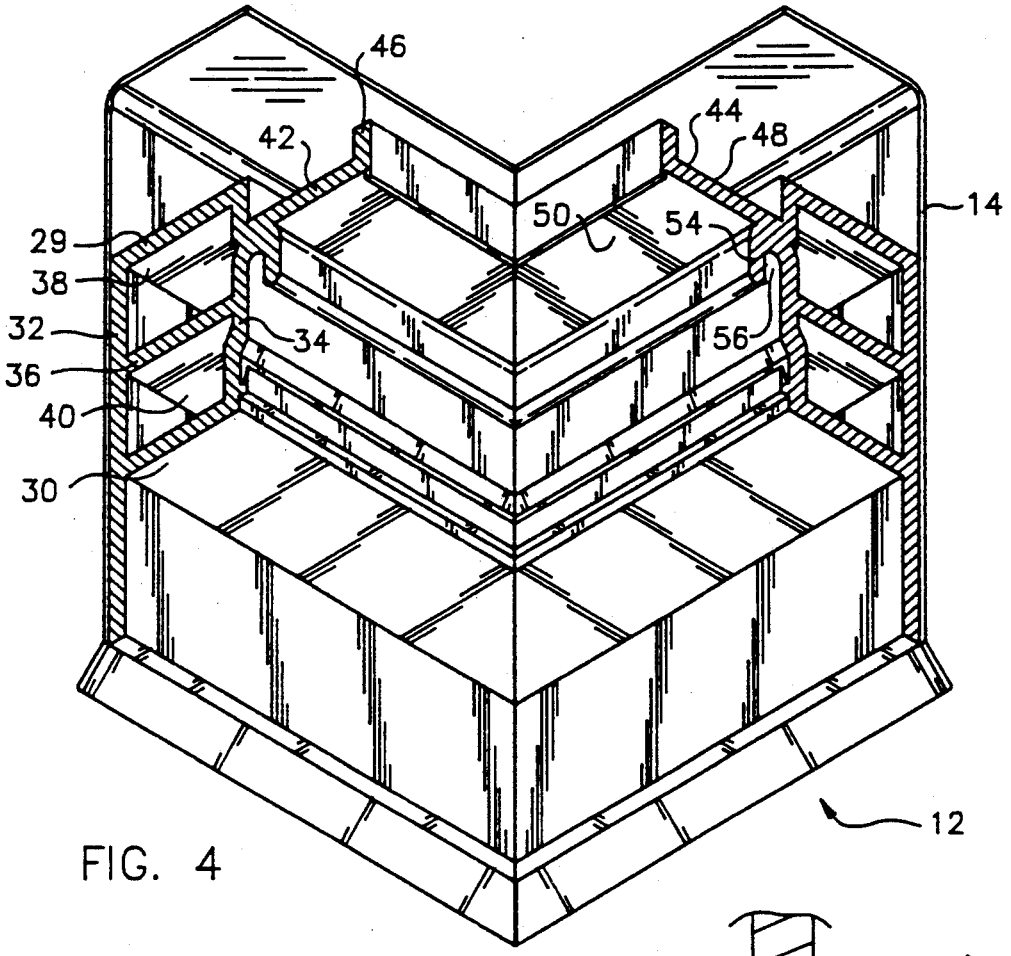
FIG. 4 is a perspective partial view of the fixed frame member of the skylight construction of the present invention.

Referring to FIGS. 1-3, a first embodiment of the present invention is described in which a skylight construction 2 includes a glazing cap 4 fixedly securing one or more sheets of exterior skylight glazing, such as safety glass 6. However, the exterior skylight glazing may also be comprised of, for example, acrylic or polycarbonate instead of safety glass. Additionally, while skylight construction 2 as shown in FIG. 1 is substantially planar, domed skylight constructions are also contemplated within the scope of the present invention.

Glazing spacing gaskets 8*a*, such as a two sided glazing tape, are located between safety glass 6 and glazing cap 4. If more than two sheets of safety glass 6 are present, spacer 10 is located therebetween. Glazing cap 4 is fixedly secured to fixed frame member 12 by securing members 14*a* which can be bolts, screws, or rivets. Preferably, securing members 14*a* are pop rivets.

Fixed frame member 12 and glazing cap 4 are secured to curb 16, which is a structural portion of the building or residence, with securing members 14*b*. Preferably, securing members 14*b* are bolts or screws. Separating curb 16 and fixed frame member 12 is curb spacing gasket 18, which is a two-sided curb tape. In this manner, fixed frame member 12, by its placement on curb 16, stabilizes glazing cap 4, which is fixedly attached thereto, and allows secure attachment of safety glass 6 between glazing cap 4 and fixed frame member 12. If more than one sheet of safety glass 6 is employed, the sheet adjacent fixed frame member 12 is spaced therefrom with an additional glazing spacing gasket 8*b*.

Removable retaining flange 22, also known as a glazing bead, is employed to removably secure a sheet or sheets of light transmissive insulating glazing 20 (interior skylight glazing) adjacent to safety glass 6 (exterior skylight glazing). As will be described in detail below, removable retaining flange 22 is removably connected to fixed frame member 12 such that a sheet or sheets of light transmissive insulating glazing 20 are secured between fixed frame member 12 and removable retaining flange 22. Glazing spacing gaskets 8*c* and 8*d* respectively separate the light transmissive insulating glazing 20 from both fixed frame member 12 and removable retaining flange 22. If more than one sheet of light transmissive insulating glazing 20 is present, spacer 10 separates them.

While the interior skylight glazing is described above as light transmissive insulating glazing 20, materials having lesser insulating qualities, such as, for example, glass, may also be employed. Thus, the interior skylight glazing of the present invention may be comprised of any light transmissive material regardless of its insulating properties. Preferably, when the interior skylight glazing is light transmissive insulating glazing 20, it is comprised of a synthetic polymer such as polycarbonate resin manufactured by General Electric of Pittsfield, Mass. under the name of "LEXAN". Most preferably, light transmissive insulating glazing 20 is comprised of a plurality of interconnected cells of polycarbonate resin.

Removable retaining flange 22 and curb 16 form a caulking passage 24 into which silicone sealant 26 is placed for air tight and water tight sealing of skylight construction 2. Silicone sealant 26 is backed by backer rod 28. Backer rod 28 resists adhesion to silicone and thus ensures a hermetical seal between curb 16 and removable retaining flange 22.

Preferably, glazing cap 4 is comprised of aluminum or other lightweight metal. Fixed frame member 12 and removable retaining flange 22 are comprised of a synthetic polymer such as polyvinyl chloride or other high molecular weight polymer that provides structural strength and convenient component connection and separation, while maximizing the insulating properties of skylight construction 2. Fixed frame member 12 and removable retaining flange 22 are preferably formed by plastic extrusion methods known in the art to ensure uniform wall thickness for ease of removal of the components from extrusion dies.

Referring to FIGS. 2–6, fixed frame member 12 is now described in detail. Fixed frame member 12 is preferably comprised of four longitudinally extending components joined at mitered corners by welding or adhesive methods known in the art. The fixed frame member 12 so formed is preferably a four-sided structure sized to retain safety glass 6 and light transmissive insulating glazing 20 of any desired dimension.

Fixed frame member 12 preferably includes top wall 29, bottom wall 30, exterior side wall 32, and interior side wall 34. As used consistently herein, the term "interior" is to denote a structural portion adjacent the sheet of light transmissive insulating glazing 20, and the term "exterior" is to denote a structural portion remote therefrom. Partition 36 is optionally located parallel to top wall 29 and bottom wall 30 and attached to exterior side wall 32 and interior side wall 34 to define first hollow 38 and second hollow 40.

Fixed frame flange 42 is a longitudinally extending member attached to interior side wall 34 or top wall 28, and is substantially parallel to top wall 29. Fixed flange 42 preferably has an exterior surface 44 and a longitudinal condensation rib 46 on exterior surface 44 defining a condensation gutter 48 for collection of condensation from safety glass 6. Fixed flange 42 also preferably has an interior surface 50 with a longitudinal glazing tape rib 52 thereon. Glazing spacing gasket 8*c* is preferably seated on interior surface 50 and retained from "walking" due to temperature changes and structural vibrations by longitudinal glazing tape rib 52.

Figure 5:
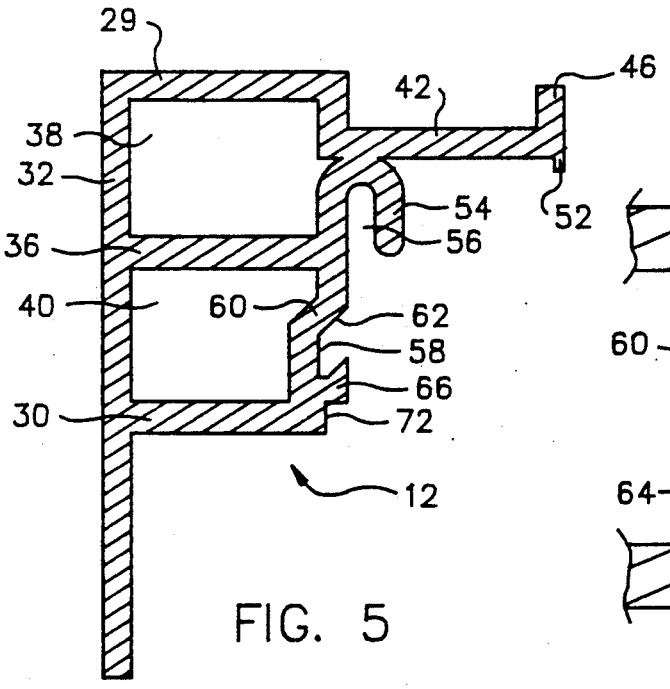
FIG. 5 is an end view of the fixed frame member of FIG. 4.
Figure 6:
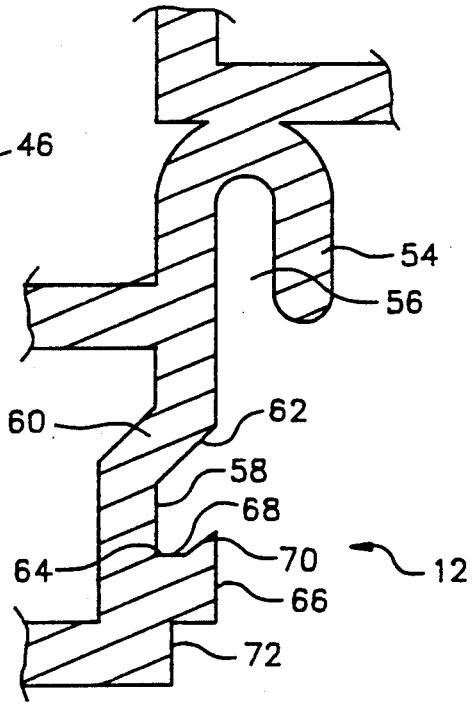
FIG. 6 is an enlarged portion of the fixed frame member of FIG. 5.

Specifically referring to FIGS. 5–6, interior side wall 34 has shoulder 54 located thereon. Shoulder 54 is preferably of inverted U-shape in cross section and extends longitudinally on interior side wall 34 adjacent to fixed frame flange 42. Shoulder 54 has groove 56 on its lower facing. Groove 56 is adapted to engage with removable retaining flange 22 as discussed in greater detail below.

Interior side wall 34 includes longitudinal recess 58, which is preferably defined by offset 60 of interior side wall 34. Recess 58 includes an upper edge 62 that is preferably oriented at less than a right angle from vertical. Most preferably, upper edge 64 is disposed at an angle of about 45° from vertical.

Recess 58 also includes a lower edge 64 that comprises catch 66. Catch 66 includes seat 68, which is oriented substantially horizontally. Catch 66 also includes catch edge 70 that is preferably oriented at less than a right angle from vertical and at an angle equal to the angle of upper edge 62 such that catch edge 70 and upper edge 62 are parallel. Most preferably, catch edge 70 is disposed at an angle of about 45° from vertical. As will be discussed in greater detail below, recess 58 as well as seat 68 and catch edge 70 of catch 68 are adapted to mate with removable retaining flange 22.

Bevel 72 is located below catch 66 on interior side wall 34. When fixed frame member 12 and removable retaining flange 22 are connected, a narrow ended instrument, such as a screwdriver or the like, can be inserted upwardly into bevel 72 and turned to separate fixed frame member 12 and removable retaining flange 22.

Referring to FIGS. 2–3 and 7–10, removable retaining flange (glazing bead) 22 is now described in detail. Removable retaining flange 22 is preferably comprised of four longitudinally extending components joined at right-angled corners by welding or adhesive methods known in the art. The removable retaining flange 22 so formed is preferably a four sided structure sized to retain light transmissive insulating glazing 20 of any desired dimension.

Removable retaining flange 22 includes horizontal leg 74 and vertical leg 76 and preferably has a cross section of substantially L-shape. Vertical leg includes end 78 that is sized and shaped to engage in groove 56 of shoulder 54 of fixed frame member 12.

Horizontal leg 74 preferably includes longitudinal curb tape rib 80 on exterior surface 82 adjacent the point of attachment of horizontal leg 74 and vertical leg 76. Curb spacing gasket 18 is preferably seated adjacent exterior surface 50 of horizontal leg 74 and curb 16, and is retained from "walking" due to temperature changes and structural vibrations by longitudinal curb tape rib 80.

Horizontal leg 74 also optionally includes return flange 84. Return flange 84 is employed as a spacer to securely fit light transmissive insulating glazing 20 of a relatively lesser depth between removable retaining flange 22 and fixed frame member 12, as shown in FIG. 2. However, if light transmissive insulating glazing 20 has a relatively larger depth, or if spacer 10 is employed to create an insulation space between layers of light transmissive insulating glazing 70 as shown in FIG. 3, return flange 84 may be omitted.

On the interior surface 56 of return flange 84, if present (as shown in FIG. 8), or on the interior surface 88 of horizontal leg 74 if return flange 84 is not present (as shown in FIG. 9), longitudinal glazing tape rib 90 is preferably located. Glazing spacing gasket 8*d* is preferably seated on interior surface 80 of return flange 84 (or interior surface 88 of horizontal leg 74) and is retained from "walking" due to temperature changes and structural vibrations by longitudinal glazing tape rib 90.

Referring specifically to FIG. 8–10, vertical leg 76 includes lip 92 extending substantially longitudinally on exterior surface 94 of vertical leg 76. Lip 92 includes a lower side 96 preferably defining recess 98. Recess 98 is preferably disposed at more than a right angle and most preferably at an angle complementary to the angle of catch edge 70 of catch 66 of fixed frame member 12 for engagement of catch edge 70 and recess 98. Most preferably, the angle of recess 98 is thus about 135° from the vertical component employed to derive the angle of catch edge 70.

Lip 92 also includes a first face 100 adjacent recess 98. First face 100 is preferably substantially parallel with seat 68 of catch 66 for flush fitting of first face 100 and seat 68 when fixed frame member 12 and removable retaining flange 22 are corrected.

Lip 92 also includes second face 102 that is adjacent, and substantially perpendicular to, first face 100. Second face 102 is substantially parallel to recess 58 of interior side wall 34 for flush fitting of second face 102 and recess 58 when fixed frame member 12 and removable retaining flange 22 are connected.

Lip 92 also has an upper side 104 adjacent second face 102. Upper side 104 is preferably disposed at an angle complementary to the angle of upper edge 62 of recess 58. Most preferably the angle of upper side 104 is thus about 135° from the vertical component employed to derive the angle of upper edge 62. Additionally, upper side 104 is substantially parallel to lower side 96.

Referring again to FIGS. 2–3, the connection of fixed frame member 12 and removable retaining flange 22 to form skylight construction 2, and the subsequent separation thereof, is now described. To connect fixed frame member 12 and removable retaining flange 22, fixed frame member 12 is preferably placed on a firm surface with top wall 28 nearest this surface. Next, a sheet (or sheets) of light transmissive insulating glazing 20 with attached glazing spacing gaskets 8*c* and 8*d* is placed on interior surface 50 of fixed frame flange 42. Removable retaining flange 22 is next connected to fixed frame member 12 by first guiding end 78 of vertical leg 76 into groove 56 of shoulder 54. Downward pressure is then applied to removable retaining flange 22, resulting in travel of end 78 of vertical leg 76 farther into groove 56 of shoulder 54, and passage of lip 92 of vertical leg 76 over catch 66 of interior side wall 34 until lip 92 engages with catch 66 and recess 58. Specifically, as described above, recess 98 of lip 92 engaged catch edge 70 of catch 66, first face 100 of lip 92 fits flushly with seat 68 of catch 66, and second face 102 of lip 92 fits flushly with recess 58 of interior side wall 34.

During the application of downward pressure onto removable retaining flange 22, the hereinbefore described angle of upper side 104 of lip 92 facilitates passage of lip 92 over the exterior of catch 66. Also, during pressure application on removable retaining flange 22, glazing spacing gaskets 8*c* and 8*d* on opposite sides of light transmissive insulating glazing 20 compress to allow movement of removable retaining flange 22 while minimizing relative movement of light transmissive insulating glazing 20 as lip 92 clears catch 66, thus preventing breakage of light transmissive insulating glazing 20.

After the above described mating of catch 66 of fixed frame member 12 and lip 92 of removable retaining flange 22, light transmissive insulating glazing is securely braced between interior surface 50 of fixed frame flange 42 and interior surface 86 of return flange 84 as shown in FIG. 2 (or the interior surface 88 of horizontal leg 74 as shown in FIG. 3). Skylight construction 2 is then placed in a building opening sized to receive skylight construction 2. Next, skylight construction 2 is fastened to the building by securing members 14*b*.

To separate fixed frame member 12 and removable retaining flange 22, securing members 14*b* are loosened and skylight construction 2 is removed from the building opening and placed upside down on a firm surface. A narrow ended instrument such as a screwdriver o the like is inserted into bevel 72 of fixed frame member 12, as stated above, and force is applied to removable retaining flange 22. Rotation of the screwdriver causes the screwdriver edge to contact the portion of the exterior surface 94 of vertical leg 76 that is below lip 92, causing lip 92 to cam upwardly and inwardly away from recess 58 and catch 66 of interior side wall 34 of fixed frame member 12. This screwdriver force also causes end 78 of vertical leg 76 to travel further into groove 56 of shoulder 54. In this manner, lip 92 clears recess 58 and catch 66, and removable retaining flange 22 is separated from fixed frame member 12.

It is important to note that to facilitate separation of fixed frame member 12 and removable retaining flange 22, the above described movement of removable retaining flange 22 relative to fixed frame member 12 is required so that lip 92 disengages from recess 58 and catch 66. Thus, a space 106 is required between upper side 104 of lip 92 and upper edge 62 of recess 58, and a space 108 is required between end 78 of vertical leg 76 and groove 56 of shoulder 54 to allow the above relative motion of removable retaining flange 22.

During the application of force to removable retaining flange 22 to facilitate separation, glazing spacing gaskets 8*c* and 8*d* adjacent light transmissive insulating glazing 20 compress, as described above, to prevent breakage of light transmissive insulating glazing 20 by forces applied to removable retaining flange 22.

When fixed frame member 12 and removable retaining flange 22 are connected to form skylight construction 2, as shown in FIGS. 2–3, the connection maintains its integrity when forces are applied to the surface of light transmissive insulating glazing 20 adjacent safety glass 6. An example of the application of such a force onto light transmissive insulating glazing 20 is the breaking of safety glass 6 and subsequent passage therethrough by a rock, tree limb or hail. When such forces impinge upon light transmissive insulating glazing 20, the relative downward force is transferred to interior surface 86 of return flange 84 as shown in FIG. 2 (or directly to the interior surface 88 of horizontal leg 74 as shown in FIG. 3). Then, this force passes to horizontal leg 74 and vertical leg 76. At this point, the downward force is transferred through lip 92 of removable retaining flange 22 to catch 66 of fixed frame member 12. The force then passes through interior side wall 34 and bottom wall 30 and passes through curb spacing gasket 18 into curb 16. The force impinging on light transmissive glazing 20 and removable retaining flange 22 is therefore passed into the structural portion of the building or residence, thus preventing undesired separation of removable retaining flange 22 from fixed frame member 20 due to this force. Additionally, the downward forces on light transmissive insulating glazing 20, and specifically on horizontal leg 74, cause vertical leg 76 to rotate outwardly away from fixed frame member 12. However, this outward rotation of vertical leg 76 is resisted by the inside surface of shoulder 54.

Figure 11:
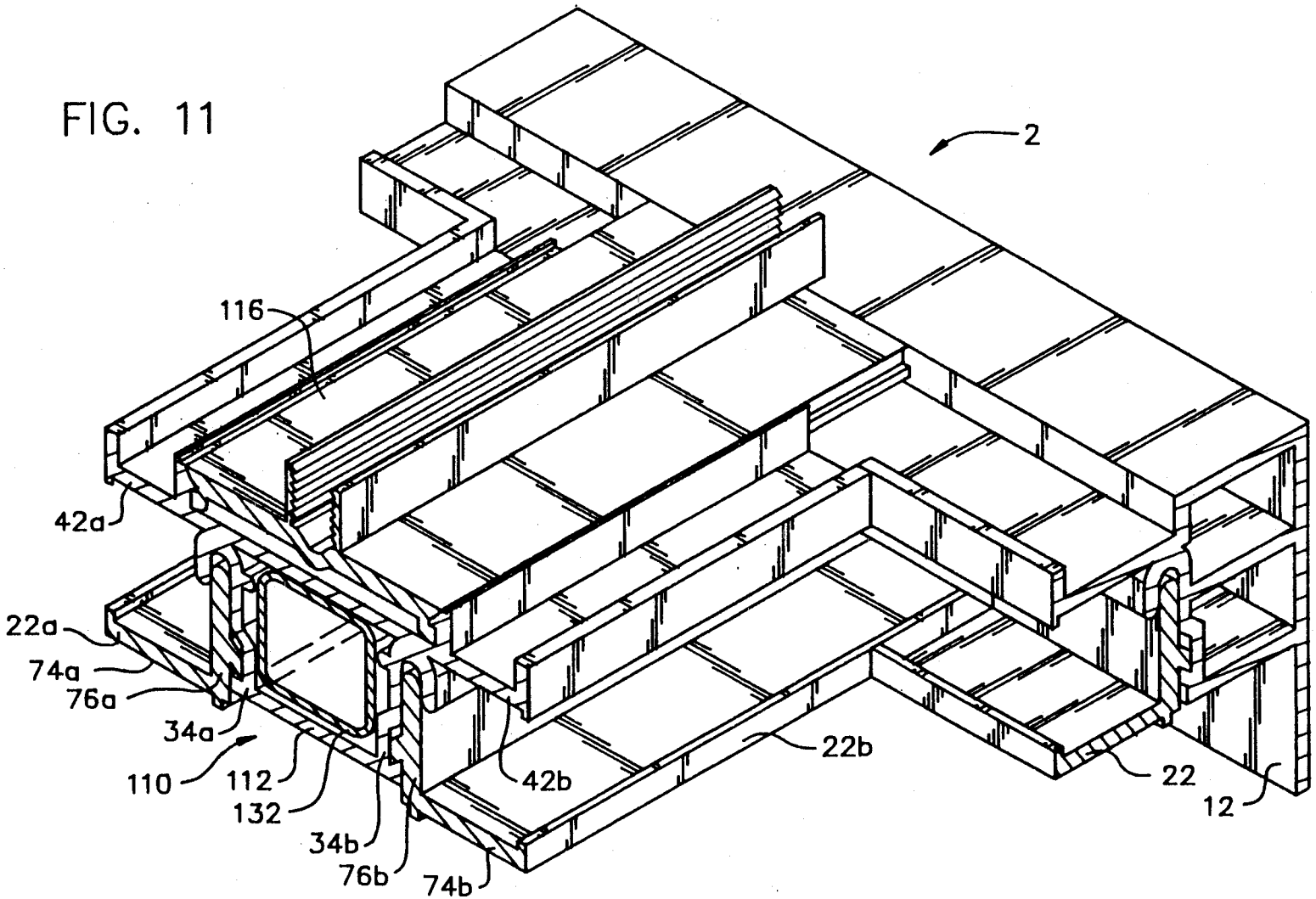
FIG. 11 is a perspective partial view of the mullion construction of the skylight construction of the present invention.
Figure 12:
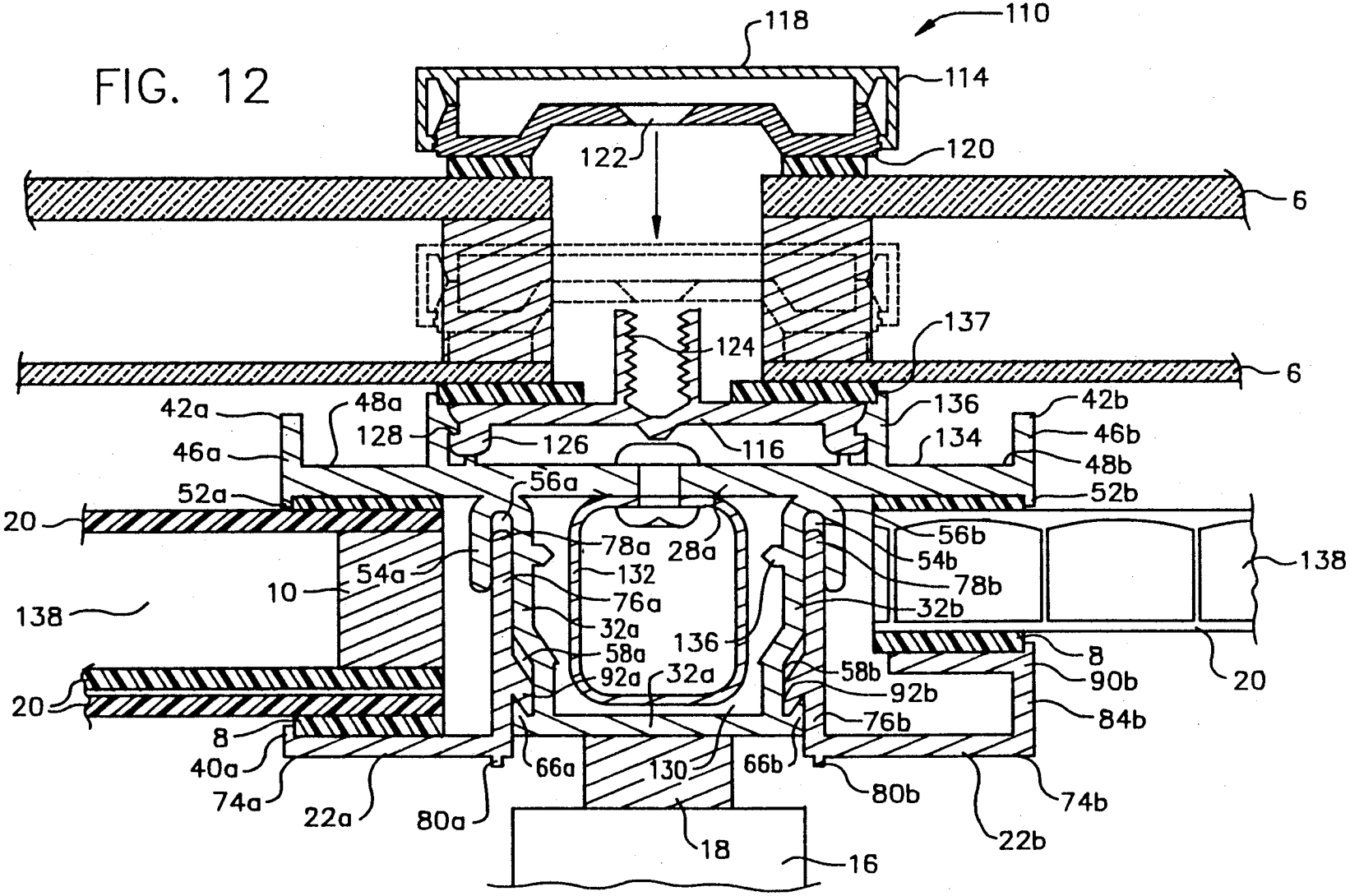
FIG. 12 is an end view of the mullion construction of FIG. 11.

Referring to FIGS. 11–12, a second embodiment of the present invention is described. The second embodiment is a mullion construction 110 for providing bracing for a skylight construction 2 having a width that requires additional structural support, for example, a width of two feet or more. Generally, mullion construction 110 is comprised of a mullion frame member 112, a mullion cap 114, a mullion plate 116, and at least first and second removable retaining flanges 22*a* and 22*b*, respectively. Note that for consistency, elements of mullion construction 110 that duplicate the above described elements of the first embodiment of the present invention retain the element numbers of the first embodiment, and these element numbers are modified by lower case arabic letters. The detailed description of these elements in the first embodiment are incorporated by reference in this second embodiment.

Mullion construction 110 is securedly attached to, and preferably bisects, skylight construction 2 by connection of mullion frame member 112 to fixed frame member 12, and by connection of first removable retaining flange 22*a* and second removable flange 22*b* to removable retaining flange 22 by welding or adhesives known in the art.

Mullion cap 114 includes a cap top 118 and a cap bottom 120 connectible thereto by rib/channel snapping engagement or the like. Cap bottom includes screw orifice 122. Mullion cap 114 is preferably comprised of aluminum.

Mullion plate 116 includes threaded screw bore 124 and legs 126 having longitudinal channels 128. Threaded screw bore 124 is oriented in alignment with screw orifice 122 for attachment of mullion plate 116 and mullion cup 114. Legs 126 and longitudinal channels 128 removably attach mullion plate 116 to mullion frame member 112 as described below. Mullion plate 116 is preferably comprised of aluminum or other light weight metal in which threaded screw bore 124 can be formed.

Mullion frame member 112, which is comprised of polyvinyl chloride or other high molecular weight polymer, includes top wall 28*a*, bottom wall 32*a*, first side wall 32*a* and second side wall 32*b*, all of which define mullion hollow 130. Mullion hollow 130 is adapted to contain a structural tube support 132 of preferably 1 inch by 1 inch. Structural tube support 132 is retained in mullion hollow 130 by longitudinal hollow ribs 134 located on each of first side wall 32*a* and second side wall 32*b*.

Extending from each edge of top wall 28*a* are first mullion flange 42*a* and second mullion flange 42*b*. First mullion flange 42*a* and second mullion flange 42*b* respectively include first condensation gutter 48*a* bounded by longitudinal condensation rib 46*a* and second condensation gutter 48*b* bounded by longitudinal condensation rib 46*b*. First condensation gutter 48*a* and second condensation 48*b* are joined with condensation gutter 48 at fixed frame member 12.

First mullion flange 42*a* and second mullion flange 42*b* also include, respectively, first longitudinal glazing tape rib 52*a* and second longitudinal glazing tape rib 52*b*, each of which prevents glazing spacing gaskets 8 from "walking" as previously stated.

Attached to the top surface of top wall 28*a* are a pair of longitudinal mullion plate retaining ribs 136 that mate with legs 126 and longitudinal channels 128 of mullion plate 116 to removably connect mullion plate 116 and mullion frame member 112. On each of longitudinal mullion plate retaining ribs 136 are longitudinal glazing ribs 137 that prevent glazing spacing gaskets 8 from "walking" as detailed above.

First side wall 32*a* and second side wall 32*b* respectively include first shoulder 54*a* and second shoulder 54*b*; first groove 56*a* and second groove 56*b*; first recess 58*a* and second recess 58*b*; and first catch 66*a* and second catch 66*b*. The above elements parallel the elements of interior side wall 32 as described in the first embodiment of the present invention.

First removable retaining flange 22*a* and second removable retaining flange 22*b* each have the elements of removable retaining flange 22 of the first embodiment of the present invention, specifically including first horizontal leg 74*a* and second horizontal leg 74*b*, each of which has a longitudinal curb tape rib 80*a* and 80*b* respectively; first longitudinal glazing tape rib 90*a* on first horizontal leg 74; second longitudinal glazing tape rib 90*b* on optional return flange 84*b*; and first vertical leg 76*a* and second vertical leg 76*b*, having ends 78*a* and 78*b*, respectively, and having lips 92*a* and 92*b*, respectively. First removable retaining flange 22*a* and second removable retaining flange 22*b* are preferably comprised of polyvinyl chloride or other high molecular weight polymer.

In assembly of mullion construction 110, mullion plate 116 is secured to mullion frame member 112 by engagement of longitudinal mullion plate retaining ribs 136 of mullion frame member 112 with legs 126 and longitudinal channels 128 of mullion plate 116. Sheets of safety glass 6, having glazing spacing gaskets 8 (double sided tape) on each side, are placed on mullion plate 116. Glazing cap 114 is then attached to glazing plate 116 by a screw inserted through screw orifice 122 of mullion cap 114 and threaded screw bore 124 of mullion plate 116.

Next, first removable retaining flange 22*a* and second removable retaining flange 22*b* are connected to first side wall 32*a* and second side wall 32*b*, respectively, in the manner describing the connection of removable retaining flange 22 to interior side wall 34 in the first embodiment. Thus, sheets of light transmissive insulating glazing 20, with glazing spacing gaskets 8 on each side, are securedly held between first mullion flange 42*a* and first horizontal leg 74*a*, and between second mullion flange 42*a* and optional return flange 84*b*.

First removable retaining flange 22*a* and second removable retaining flange 22*b* are separated from mullion frame member 112 in the manner describing the separation of removable retaining flange 22 from fixed frame member 12 in the first embodiment.

An important aspect of the second embodiment of the present invention is the polyvinyl chloride or other high molecular weight polymer composition of the elements of mullion construction 110, excluding mullion plate 116 and mullion cap 114, which are made of aluminum or other light weight metal. The polyvinyl chloride composition of mullion construction 110 prevents leaching of heat from insulating space 138 between the sheets of light transmissive insulating glazing 20 through first mullion flange 42*a* and second mullion flange 42*b* and into the aluminum mullion plate 116.

While particular embodiments of the present invention have been described in some detail herein above, changes and modifications may be made in the illustrated embodiments without departing from the spirit of the invention.

I claim:

1. A construction for removably retaining at least a first sheet of glazing adjacent to at least a second sheet of glazing, said construction comprising:

a fixed frame member adapted to be disposed adjacent to a curb or a glazing cap, said fixed frame member having at least a side wall, said fixed frame member having a fixed frame flange adjacent to said side wall, said fixed frame flange having an interior side and an exterior side, said side wall having a shoulder extending substantially longitudinally on said side wall and located adjacent said interior side of said fixed frame flange, said shoulder having a groove therein, said side wall having a recess extending longitudinally thereon in which a lower extent of said recess spaced from said shoulder and groove has a catch angled inwardly and toward said fixed frame flange; and a removable retaining flange having a substantially vertical leg and a substantially horizontal leg, said vertical leg having an end adapted to mate in said groove of said shoulder of said fixed frame member and having a lip extending substantially longitudinally thereon for engaging said catch by a vertical installation movement forced along said side wall of the fixed frame member until said lip passes over said catch while said end of said vertical leg of the removable retaining flange is forced into said groove of the fixed frame member, said horizontal leg of said removable retaining flange having an interior side and an exterior side, whereby when said removable retaining flange and said fixed frame member are connected by engagement of said shoulder of said fixed frame member and said vertical leg end of said removable retaining flange and by engagement of said catch of said fixed frame member and said lip of said removable retaining flange, at least a first sheet of glazing is removably braced against said fixed frame member adjacent at least a second sheet of glazing and is held in the braced position between said interior side of said fixed frame flange and said interior side of said horizontal leg of said removable retaining flange.

2. The construction for removably retaining a first sheet of glazing of claim 1 further comprising:

an interior partition in said fixed frame member substantially perpendicular to said side wall and attached to said side wall to define a first hollow and a second hollow.

3. The construction for removably retaining a first sheet of glazing of claim 1 further comprising:

a first substantially longitudinal rib on said interior side of said fixed frame flange; and a second substantially longitudinal rib on said interior side of said horizontal leg of said removable retaining flange, said first rib and said second rib adapted to retain, adjacent said interior side of said fixed frame flange and said interior side of said horizontal leg, respectively, spacing gaskets located on each side of a first sheet of glazing.

4. The construction for removably retaining a first sheet of glazing of claim 1 further comprising:

a substantially longitudinal rib on said exterior side of said fixed frame flange, said substantially longitudinal rib and said fixed frame flange defining a gutter for the collection of condensation.

5. The construction for removably retaining a first sheet of glazing of claim 1 wherein said side wall recess of said fixed frame member has an upper edge defined by an offset of said side wall, said upper edge of said side wall recess is disposed at less than a right angle from vertical and said lip of said removable retaining flange vertical leg has an upper side disposed at an angle complementary to the angle of said upper edge of said side wall recess.

6. The construction for removably retaining a first sheet of glazing of claim 1 wherein said removable retaining flange further comprises:

a return flange on said horizontal leg, said return flange having an exterior side and a rib on said exterior side, said exterior side adapted to seat a spacing gasket located on a first sheet of glazing, and said rib adapted to retain the spacing gasket.

7. The construction for removably retaining a first sheet of glazing of claim 1 wherein said construction is comprised of polyvinyl chloride.

8. The construction for removably retaining a first sheet of glazing of claim 1 wherein said glazing is divided into a plurality of cells.

9. The construction for removably retaining a first sheet of glazing of claim 1 wherein said glazing is comprised of polycarbonate resin.

10. A construction for removably retaining at least first and second sheets of glazing adjacent additional sheets of glazing material, said construction comprising:

a mullion adapted to be removably connected to a glazing plate that secures sheets of glass and that is attached to a glazing cap, said mullion having a top wall, a bottom wall, a first side wall adjacent a first sheet of glazing and a second side wall adjacent a second sheet of glazing and defining a mullion hollow for housing a structural support tube, said top wall having at least a pair of longitudinally disposed glazing plate snap ribs adapted to removably connect said mullion to a glazing plate, said top wall having a first mullion flange on a first edge of said top wall and a second mullion flange on a second edge of said top wall, said first mullion flange and said second mullion flange each having an interior side and an exterior side, said first side wall and said second side wall respectively having a first shoulder and a second shoulder, said first shoulder and said second shoulder having substantially inverted U-shaped cross-sections, said first shoulder and said second shoulder extending substantially longitudinally on said first side wall and on said second side wall respectively and located adajacent said interior sides of said first mullion flange and said second mullion flange respectively, each of said first shoulder and said second shoulder having a lower facing with a groove thereon, said first side wall and said second side wall respectively having a first recess and a second recess extending substantially longitudinally thereon and adjacent said first shoulder and said second shoulder respectively, said first side wall recess and said second side wall recess each having an upper edge and a lower edge, said lower edges of said first side wall recess and said second side wall recess respectively comprising a first catch and a second catch extending substantially longitudinally on said first side wall and said second side wall respectively, said first catch and said second catch each having a seat substantially parallel to said top wall and said bottom wall and having a catch edge disposed at less than a right angle to vertical, said first side wall and said second side wall each having a longitudinally extending bevel below said first catch and said second catch respectively; and a first removable retaining flange and a second removable retaining flange, each of said first removable retaining flange and said second removable retaining flange including:

a vertical leg, and a horizontal leg connected to said vertical leg to define a substantially L-shaped cross-section, said vertical leg having an end adapted to mate in said groove of one said first shoulder and said second shoulder, said vertical leg having a lip extending substantially longitudinally thereon, said lip having an upper side and a lower side, said lower side defining a recess disposed at an angle complementary to the angle of one of said first catch edge and said second catch edge for mating of said lip recess and said one of said first catch edge and said second catch edge, said lip having a first face adjacent said lip recess and substantially parallel said seat of one of said first catch and said second catch for flush fitting thereof, said lip having a second face adjacent and substantially perpendicular to said first face and substantially parallel to one of said first side wall recess and said second side wall recess of said fixed frame member for flush fitting thereof, said horizontal leg having an interior side and an exterior side and a rib extending substantially longitudinally on said exterior side, whereby when said first removable retaining flange and said second removable retaining flange are respectively connected with said first side wall and said second side wall of said mullion by engagement of said first shoulder of said first side wall with said vertical leg end of said first removable retaining flange, by engagement of said second shoulder of said second side wall with said vertical leg end of said second removable retaining flange, by engagement of said first catch of said first side wall and said lip of said first removable retaining flange, and by engagement of said second catch of said second side wall and said lip of said second removably retaining flange, a first sheet of glazing having spacing gaskets on each side is removably braced against said mullion adjacent additional sheets of glazing and is held in the braced position between said interior side of said first mullion flange and said interior side of said horizontal leg of said first removable retaining flange, and a second sheet of glazing having spacing gaskets on each side is removably braced against said mullion adjacent additional sheets of glazing and is held in the braced position between said interior side of said second mullion flange and said interior side of said horizontal leg of said second removable retaining flange.

11. The construction for removably retaining at least first and second sheets of glazing material adjacent to additional sheets of glazing material of claim 10 wherein said construction is comprised of polyvinyl chloride and the glazing plate is comprised of aluminum.

12. The construction for removably retaining at least first and second sheets of glazing material adjacent to additional sheets of glazing material of claim 10 further comprising:

a first substantially longitudinal rib on said interior side of said each of said first mullion flange and said second mullion flange; and a second substantially longitudinal rib on said interior side of said horizontal leg of each of said first removable retaining flange and said second removable retaining flange, each of said first ribs and each of said second ribs adapted to retain, adjacent said interior side of each of said first mullion flange and said second mullion flange and said interior side of said horizontal leg of each of said first removable retaining flange and said second removable retaining flange, spacing gaskets located on each side of a sheet of light transmissive insulating material.

13. The construction for removably retaining at least first and second sheets of glazing material adjacent to additional sheets of glazing material of claim 10 further comprising:

a substantially longitudinal rib on said exterior side of each of said first mullion flange and said second mullion flange, each of said substantially longitudinal ribs and each of said first mullion flange and said second mullion flange defining a gutter for the collection of condensation.

14. The construction for removably retaining at least first and second sheets of glazing material adjacent to additional sheets of glazing material of claim 10 wherein said upper edge of each of said first side wall recess and said second side wall recess of said mullion is defined by an offset of said first side wall and said second side wall, respectively, each of said upper edge of said first side wall recess and said second side wall recess is disposed at less than a right angle from vertical, said first side wall recess and said second side wall recess, and said upper side of said vertical leg lip of each of said first removable retaining flange and said second removable retaining flange is disposed at an angle complementary to the angle of said upper edge of said first side wall recess and said second side wall recess, respectfully.

15. The construction for removably retaining at least first and second sheets of glazing material adjacent to additional sheets of glazing material of claim 10 wherein each of said first removable retaining flange and said second removable retaining flange further comprises:

a return flange on said horizontal leg, said return flange having an exterior side and a rib on said exterior side, said exterior side adapted to seat a spacing gasket located on a sheet of light transmissive insulating material, and said rib adapted to retain the spacing gasket.

16. The construction for removably retaining at least first and second sheets of glazing material adjacent to additional sheets of glazing material of claim 10 wherein said light transmissive insulating material is divided into a plurality of cells.

17. The construction for removably retaining at least first and second sheets of glazing material adjacent to additional sheets of glazing material of claim 10 wherein said light transmissive insulating material is comprised of polycarbonate resin.

18. A construction for removably retaining a sheet of light transmissive insulating material adjacent to a sheet of glass, said construction comprising:

a fixed frame member adapted to be disposed adjacent to a curb or a glazing cap, said fixed frame member having a top wall, a bottom wall, a first side wall, and a second side wall, said fixed frame member having a fixed frame flange substantially parallel to said top wall and said bottom wall and attached to said first side wall, said fixed frame flange having an interior side and an exterior side, said first side wall having a shoulder of substantially U-shaped cross-section, said shoulder extending longitudinally on said first side wall and located adjacent said interior side of said fixed frame flange, said shoulder defining a groove, said first side wall having a recess extending longitudinally thereon, said side wall recess having an upper edge and a lower edge, said lower edge comprising a catch extending substantially longitudinally on said first side wall, said catch having a seat substantially parallel to said top wall and said bottom wall and having a catch edge disposed at less than a right angle to vertical, said first side wall having a longitudinally extending bevel below said catch; and a removable retaining flange of substantially L-shape in cross-section, said removable retaining flange having a vertical leg and a horizontal leg, said vertical leg having an end adapted to mate in said groove of said shoulder of said fixed frame member, said vertical leg having a lip extending substantially longitudinally thereon, said lip having an upper side and a lower side, said lower side defining a recess disposed at an angle complementary to the angle of said catch edge of said fixed frame member for mating of said lip recess and said catch edge of said fixed frame member, said lip having a first face adjacent said lip recess and substantially parallel to said seat of said fixed frame member catch for flush fitting thereof, said lip having a second face adjacent and substantially perpendicular to said first face and substantially parallel to said side wall recess of said fixed frame member for flush fitting thereof, said horizontal leg of said removable retaining flange having an interior side and an exterior side and a rib extending substantially longitudinally on said exterior side, whereby when said removable retaining flange and said fixed frame member are connected by engagement of said catch of said fixed frame member and said lip of said removable retaining flange and by engagement of said shoulder of said fixed frame member and said vertical leg end of said removable retaining flange, a sheet of light transmissive insulating material having spacing gaskets on each side is removably braced between said interior side of said fixed frame flange and said interior side of said horizontal leg of said removable retaining flange.

19. The construction for removably retaining a sheet of light transmissive insulating material of claim 18 further comprising:

an interior partition bisecting said fixed frame member to define a first hollow and a second hollow.

20. The construction for removably retaining a sheet of light transmissive insulating material of claim 18 further comprising:

a first substantially longitudinal rib on said interior side of said fixed frame flange; and a second substantially longitudinal rib on said interior side of said horizontal leg of said removable retaining flange, said first rib and said second rib adapted to retain, adjacent said interior side of said fixed frame flange and said interior side of said horizontal leg, respectively, spacing gaskets located on each side of a sheet of light transmissive insulating material.

21. The construction for removably retaining a sheet of light transmissive insulating material of claim 18 further comprising:

a substantially longitudinal rib on said exterior side of said fixed frame flange, said substantially longitudinal rib and said fixed frame flange defining a gutter for the collection of condensation.

22. A construction for removably retaining at least a first sheet of glazing adjacent to at least a second sheet of glazing, said construction comprising:

a fixed frame member adapted to be disposed adjacent to a curb or a glazing cap, said fixed frame member having at least a side wall and a fixed frame flange adjacent to said side wall, said fixed frame flange having an interior side, said side wall having a substantially longitudinally disposed shoulder located adjacent said interior side of said fixed frame flange, said shoulder having a groove therein, said side wall having a recess extending longitudinally thereon comprising a catch having a surface angled toward said fixed frame flange; and a removable retaining flange having a substantially vertical leg and a substantially horizontal leg formed as an integrally extruded unit, said vertical leg having an end adapted to mate in said groove of said shoulder of said fixed frame member, said vertical leg having a lip extending substantially longitudinally thereon, said horizontal leg of said removable retaining flange having an interior side, said removable retaining flange and said fixed frame member are connected by engagement of said shoulder of said fixed frame member with said vertical leg end of said removable retaining flange and by forced vertical movement of said lip of said removable retaining flange along said fixed frame member side wall until engagement of said catch by said lip, at least a first sheet of glazing is removably braced against said fixed frame member adjacent at least a second sheet of glazing and is held in the braced position between said interior side of said fixed frame flange and said interior side of said horizontal leg of said removable retaining flange.

* * * * *